US010510473B2

(12) United States Patent
Yoshida et al.

(10) Patent No.: US 10,510,473 B2
(45) Date of Patent: Dec. 17, 2019

(54) SWITCHGEAR

(71) Applicant: Mitsubishi Electric Corporation, Chiyoda-ku, Tokyo (JP)

(72) Inventors: Tadahiro Yoshida, Tokyo (JP); Koichi Kagawa, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 426 days.

(21) Appl. No.: 15/317,150

(22) PCT Filed: Mar. 6, 2015

(86) PCT No.: PCT/JP2015/056656

§ 371 (c)(1),
(2) Date: Dec. 8, 2016

(87) PCT Pub. No.: WO2016/042803

PCT Pub. Date: Mar. 24, 2016

(65) Prior Publication Data

US 2017/0125182 A1 May 4, 2017

(30) Foreign Application Priority Data

Sep. 18, 2014 (JP) ..... 2014-190186

(51) Int. Cl.
*H01F 7/18* (2006.01)
*H01F 7/16* (2006.01)
(Continued)

(52) U.S. Cl.
CPC ..... *H01F 7/18* (2013.01); *H01F 7/064* (2013.01); *H01F 7/16* (2013.01); *H01H 9/24* (2013.01); *H01H 47/22* (2013.01)

(58) Field of Classification Search
CPC ..... H01H 9/24; H01H 33/38; H01H 50/323; H01H 2050/325; H01H 9/20; H01H 47/22;
(Continued)

(56) References Cited

U.S. PATENT DOCUMENTS 6,674,349 B1 * 1/2004 Bolongeat ..... H01H 33/38 310/29
9,905,348 B2 * 2/2018 Kim ..... H01F 7/18
(Continued)

FOREIGN PATENT DOCUMENTS

CN 101523535 A 9/2009
EP 3196912 A4 * 5/2018 ..... H01H 33/38
(Continued)

OTHER PUBLICATIONS

International Search Report (PCT/ISA/210) dated May 26, 2015, by the Japanese Patent Office as the International Searching Authority for International Application No. PCT/JP2015/056656.
(Continued)

*Primary Examiner* — Thienvu V Tran
*Assistant Examiner* — Christopher J Clark
(74) *Attorney, Agent, or Firm* — Buchanan Ingersoll & Rooney PC

(57) ABSTRACT

For the purpose of obtaining a switchgear that can perform a reliable operation, the switchgear includes: opening and closing coils that drive a movable element, opening and closing capacitors that supply energy to the coils, opening and closing control sections that perform control of charging the capacitors and of energizing the coils, an opening coil that drives the movable element to the open side, an opening capacitor frat supplies energy to the coil, a second opening control section that performs control of charging the opening capacitor and of energizing the opening coil, and an inter-
(Continued)

lock circuit that energizes the second opening control section; and a signal showing that the second opening control section is in operation is supplied to an interlock circuit.

7 Claims, 3 Drawing Sheets

(51) Int. Cl.
*H01F 7/06* (2006.01)
*H01H 47/22* (2006.01)
*H01H 33/38* (2006.01)
*H01H 9/24* (2006.01)

(58) Field of Classification Search
CPC ... H01F 7/06; H01F 7/064; H01F 7/16; H01F 2007/1692; H01F 7/18
See application file for complete search history.

(56) References Cited

U.S. PATENT DOCUMENTS

2002/0044403 A1* 4/2002 Takeuchi ..... H01H 33/285 361/152
2007/0222427 A1* 9/2007 Takeuchi ..... G01R 31/043 324/71.2
2009/0138212 A1* 5/2009 Maruyama ..... H01F 7/1844 702/34
2009/0201109 A1 8/2009 Hashimoto et al.
2009/0284334 A1* 11/2009 Kim ..... H01H 33/38 335/185
2012/0292998 A1* 11/2012 Nagayasu ..... H01H 33/38 307/43
2014/0226250 A1* 8/2014 Takeuchi ..... H01H 33/59 361/165
2015/0371748 A1* 12/2015 Kim ..... H01F 7/18 361/190

FOREIGN PATENT DOCUMENTS

JP 59-101729 A 6/1984
JP 4-111237 U 9/1992
JP 2000251590 A * 9/2000 ..... H01H 33/285
JP 2007-157830 A 6/2007
JP 2007-323989 A 12/2007
JP 2008-53387 A 3/2008
JP 2010-272296 A 12/2010
JP 2012-129143 A 7/2012

OTHER PUBLICATIONS

Office Action dated Mar. 15, 2018, by the Chinese Patent Office in corresponding Chinese Patent Application No. 2015800355162 and English translation of the Office Action. (15 pages).

* cited by examiner

SWITCHGEAR

TECHNICAL FIELD

The present invention relates to a switchgear such as a circuit breaker of an electromagnetic operating system for use in electric power receiving and delivering facilities.

BACKGROUND ART

In a conventional circuit breaker, open operation is sometimes performed more reliably by making operating coil duplex for the purpose of improving reliability in a system (for example, see Patent Document 1, Patent Document 2). Furthermore, as a conventional technique, a time delay of energization due to a timer is sometimes set so that both opening and closing coils are not energized at the same time (for example, see Patent Document 2).

Further, there is known an electromagnetic operating device of a system in which a closing or opening coil is energized by energy charged in a capacitor to be excited and a movable element is driven by magnetic force (for example, see Patent Document 3).

RELATED ART DOCUMENT

Patent Document

Patent Document 1: JP-A-2007-323989 (FIG. 8, FIG. 9)

Patent Document 2: JP-U-H4(1992)-111237 (FIG. 1, FIG. 2)

Patent Document 3: JP-A-2012-129143 (FIG. 1, FIG. 2)

SUMMARY OF THE INVENTION

Problems to be Solved by the Invention

However, the conventional circuit breaker disclosed in Patent Document 1 or Patent Document 2 is configured to make an operating device drive by the storaged force of an interruption spring by disengaging a latch portion in the operating device by energization of an opening coil; and accordingly, a problem exists in that a link system is complicated and the operating device becomes large. Furthermore, when an operating device is the electromagnetic operating device as in switchgear disclosed in Patent Document 3, the operating device is not an engagement structure of a mechanical latch portion, but the operating device is driven by being energized by the energy charged in the capacitor from a control section. However, in this case, two sets of "capacitors and control sections" are each individually provided in parallel to two coils to control independently (that is, control in two systems). Accordingly, since two control sections are independently connected in parallel, energization is likely to be performed at the same time if both systems are not controlled in cooperation. More specifically, if both opening and closing coils are energized at the same time, the electromagnetic operating device does not perform a predetermined opening or closing operation and accordingly a problem exists in that a predetermined protective operation of the switchgear cannot be performed.

The present invention has been made to solve the above described problem, and an object of the present invention is to provide a switchgear that can perform a reliable operation by preventing both opening and closing coils from being energized at the same time.

Means for Solving the Problems

According to the present invention, there is provided a switchgear including: a closing coil that drives a movable element to the close contact side of the switchgear in an electromagnetic operating device; a closing capacitor that supplies electrical energy to the closing coil; a closing control section which is connected between the closing coil and the closing capacitor, and performs control of charging the closing capacitor and of energizing the closing coil; an opening coil that drives the movable element to the open contact side of the switchgear in the electromagnetic operating device; an opening capacitor that supplies electrical energy to the opening coil; an opening control section which is connected between the opening coil and the opening capacitor, and performs control of charging the opening capacitor and of energizing the opening coil; a first interlock circuit that energizes the closing control section or the opening control section; a second opening coil that drives the movable element to the open contact side of the switchgear in the electromagnetic operating device; a second opening capacitor that supplies electrical energy to the second opening coil; a second opening control section which is connected between the second opening coil and the second opening capacitor, and performs control of charging the second opening capacitor and of energizing the second opening coil; and a second interlock circuit that energizes the second opening control section. Wherein either said opening coil or said second opening coil is enabled to drive said movable element to the open contact side of said switchgear, and the operation of the closing control section is blocked on the basis of a signal showing that the second opening control section is in operation.

Advantageous Effect of the Invention

According to the present invention, there can be obtained a switchgear which can prevent both opening and closing coils from being energized at the same time from two control sections and performs a reliable operation.

MODE FOR CARRYING OUT THE INVENTION

Embodiment 1

Figure 1:
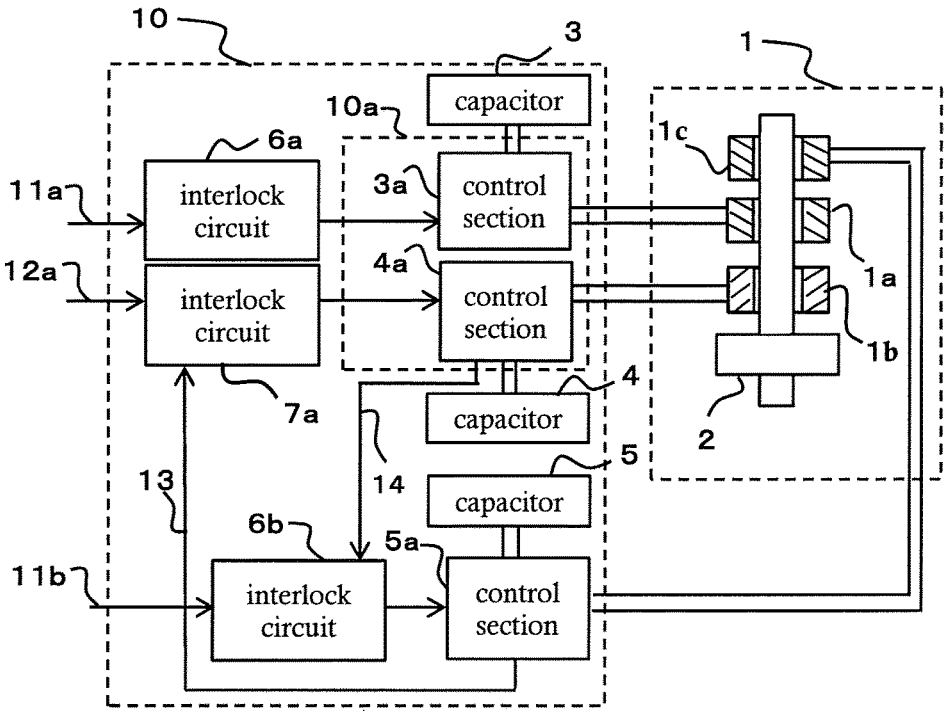
FIG. 1 is a general outline view showing an operation circuit of a circuit breaker in Embodiment 1 of the present invention.

FIG. 1 is a general outline view showing an operation circuit of a circuit breaker of Embodiment 1 of the present invention; and hereinafter, the present invention will be described on the basis of drawings.

In FIG. 1, an electromagnetic operating device 1 is constituted with opening coils 1*a*, 1*c* and a closing coil 1*b*, which are disposed so as to wind around the outer periphery of a movable element 2 with respect to the movable element 2 coupled to a movable contact of the circuit breaker (not shown in the drawing) or the like. An operation circuit 10 is provided to make the electromagnetic operating device 1 such as this drive. The operation circuit 10 includes: capacitors 3, 4 which are connected to coils 1*a*, 1*b* of the electromagnetic operating device 1, respectively, and which are for generating electromagnetic force by supplying electrical energy necessary for operation; control sections 3*a*, 4*a* having a switching function which performs switching of charging operation or discharging operation (energization operation to the coils) with respect to the capacitors 3, 4 and energization, respectively; and interlock circuits 6*a*, 7*a* that supply a driving signal to these control sections 3*a*, 4*a*, respectively. Here, the control section 3*a* supplies current to the opening coil 1*a* to drive the movable element 2 to the open contact side; and the control section 4*a* supplies current to the closing coil 1*b* to drive the movable element 2 to the close contact side.

Furthermore, when electrical energy necessary for opening contact of the electromagnetic operating device 1 is charged to the capacitor 3 via the control section 3*a* and an opening command 11*a* is inputted, and if an interlock condition is satisfied, the opening command 11*a* is inputted to the control section 3*a* via the interlock circuit 6*a* and the electrical energy charged in the capacitor 3 is discharged to the opening coil 1*a* via the control section 3*a*; and the electromagnetic operating device 1 is made to be driven. Then, when electrical energy necessary for close contact of the electromagnetic operating device 1 is charged to the capacitor 4 via the control section 4*a* and a closing command 12*a* is inputted, and if an interlock condition is satisfied, the closing command 12*a* is inputted to the control sections 4*a* via the interlock circuit 7*a* and the electrical energy charged in the capacitor 4 is discharged to the closing coil 1*b* via the control section 4*a*; and the electromagnetic operating device 1 is made to be driven.

Incidentally, a configuration is made such that only either the opening command 11*a* or the closing command 12*a* is inputted to the control section 3*a* or the control section 4*a* by the interlock circuit 6*a* or the interlock circuit 7*a*. Furthermore, the control sections 3*a*, 4*a* are integrated into an electronic board to be constituted as one control unit 10*a*.

Figure 2:
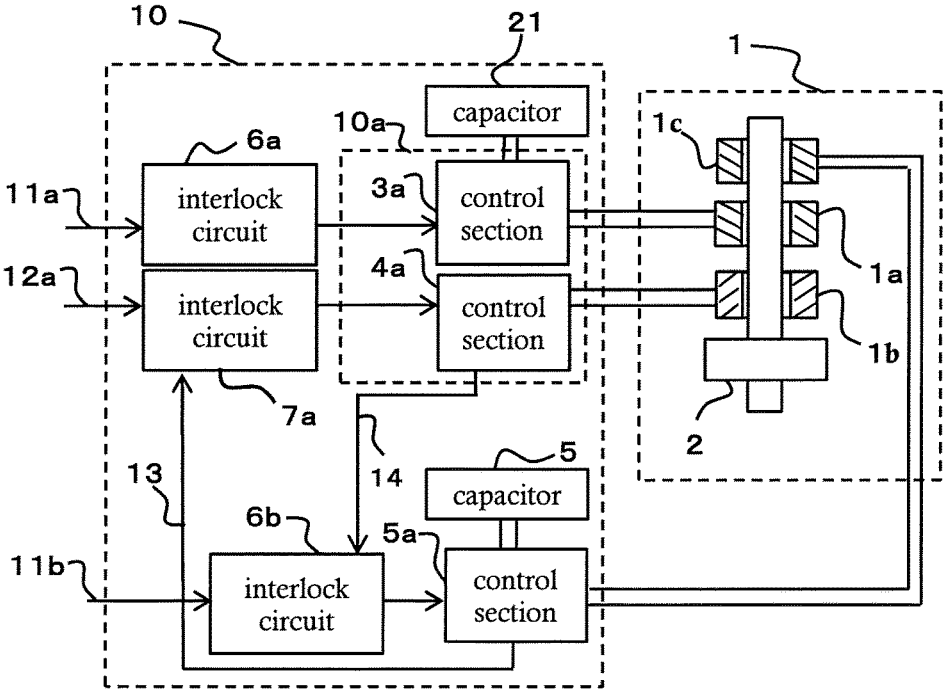
FIG. 2 is a general outline view showing another example in Embodiment 1.

Further, as shown in FIG. 2, an opening capacitor and a closing capacitor can be constituted by one capacitor 21.

With respect to the above electromagnetic operating devices 1, in order to make opening operation redundant, a configuration is made such that an opening coil 1*c* is added, a capacitor 5 and a control section 5*a* are added in response to the opening coil 1*c*, and either the opening coil 1*a* or the opening coil 1*c* can drive the electromagnetic operating device 1. As a case example that is provided with such two opening coils, it is conceivable that the opening coil 1*c* is coaxially wound on the opening coil 1*a* in overlapped relation, or both the opening coil 1*a* and the opening coil 1*c* are arranged side by side in the axial direction of the movable element 2 so as to surround the movable element 2 in the electromagnetic operating device 1.

Here, when a configuration is made such that an opening command 11*b* independent from the interlock circuits 6*a*, 7*a* is inputted to an interlock circuit 6*b* that supplies a driving signal to the control section 5*a*, the closing command 12*a* and the opening command 11*b* are considered to be inputted at the same time.

When the closing command 12*a* and the opening command 11*b* are inputted at the same time in such a manner, the movable element 2 of the electromagnetic operating device 1 receives forces in opposite directions of the open contact side and the close contact side at the same time; and as a result, this may lead to a defective operation.

Consequently, in the present invention, there is used a contact signal which is turned ON immediately after the command is inputted and is turned OFF when energization to the coil is completed in the control section 5*a*. More specifically, a configuration is made such that a contact signal 13 is outputted since the opening command 11*b* has been inputted to the control section 5*a* until the energization of the opening coil 1*c* is completed and the contact signal 13 is supplied to the interlock circuit 7*a* to block the supply of the closing command 12*a* to the control section 4*a*.

Furthermore, a configuration is made such that when the closing coil 1*b* is energized, a contact signal 14 is outputted from the control section 4*a* to be supplied to the interlock circuit 6*b* and the supply of the opening command 11*b* to the control section 5*a* is blocked while the contact signal 14 is inputted.

With such a configuration, the closing command 12*a* and the opening command 11*b* can be prevented from being supplied to the electromagnetic operating device 1 at the same time.

Incidentally, when the opening command 11*a* and the opening command 11*b* are overlapped, electromagnetic force is exerted to the same direction and therefore it is assumed to produce little effect on the configuration of the electromagnetic operating device.

As described above, in the case where the open side device is configured as a duplex system, the contact signal that shows an operation state is feed back from the control section to the interlock circuit; and thus, an operational failure of the electromagnetic operating device 1 can be prevented.

Incidentally, in Embodiment 1, there has been shown the case where the open circuit is made duplex; however, multiplexing can be achieved by further adding operating circuits and by monitoring outputs of contact signals among a plurality of control sections.

Embodiment 2

Figure 3:
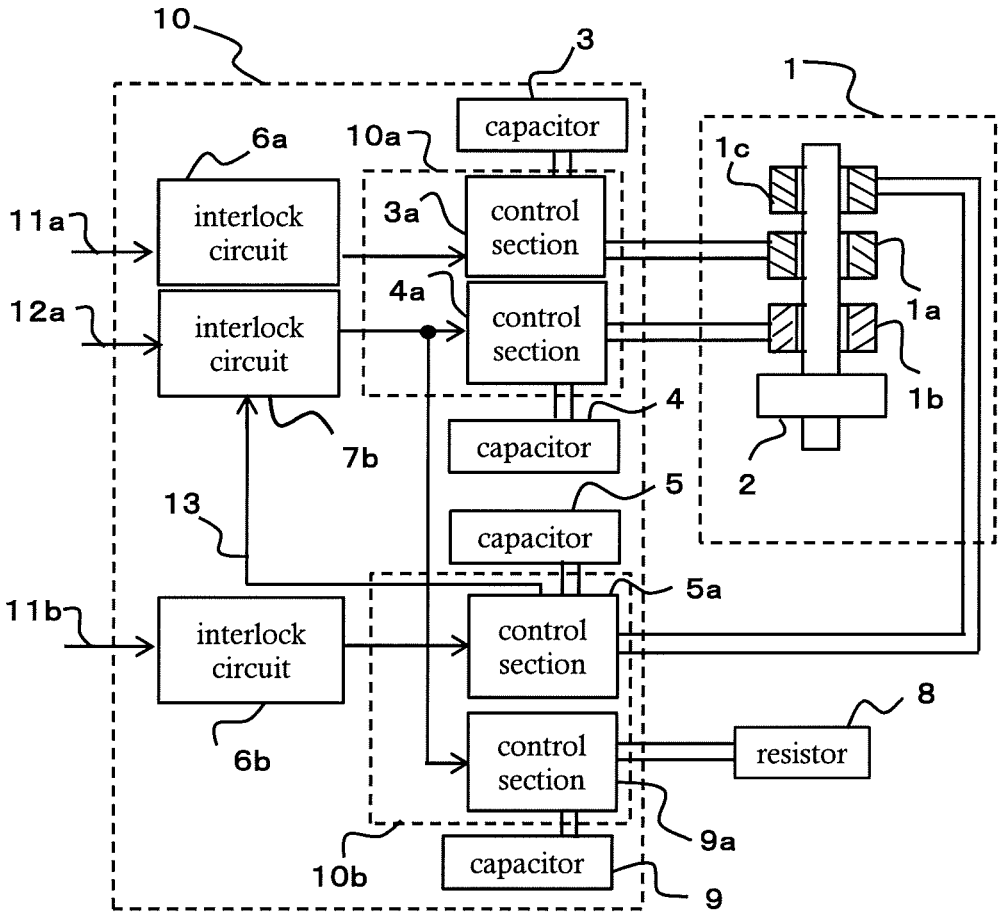
FIG. 3 is a general outline view showing an operation circuit of a circuit breaker in Embodiment 2 of the present invention.

FIG. 3 is a general outline view showing an operation circuit of a circuit breaker of Embodiment 2 of the present invention; and hereinafter, the present invention will be described on the basis of FIG. 3.

In FIG. 3, the same reference numerals as those shown in FIG. 1 represent identical or corresponding configuration and their description will be omitted.

Embodiment 2 shows a configuration in which a control unit 10*a* and a control unit 10*b*, which are manufactured by the same manufacturing device, are arranged side by side.

Here, when only an opening operation circuit is made redundant (duplex) and a closing operation circuit does not need to be made redundant (duplex), it is conceivable that one closing command 12*a* is divided to be inputted to control sections 4*a*, 9*a* of the closing operation circuit so that a control section 5*a* and a control section 9*a* are not operated at the same time. At this time, a capacitor 9 and a closing coil need to be connected with respect to the control section 9*a* of the close contact side. However, functionally, since the coil does not need to be doubly arranged together with a closing coil 1*b*, a configuration is made such that, for example, a resistor 8 simulated to the coil is connected and is arranged separately from an electromagnetic operating device 1.

Here, if a value of the resistor 8 is set to be larger than the closing coil 1*b* to such an extent that does not obstruct the operation, energization current is suppressed and shapes (the thickness of wire, the width of a substrate pattern, etc.) related to energization capacity of the circuit can be suppressed to be small. Further, since energy necessary for electromagnetic operation to the closing coil also does not need to be charged to the capacitor 9, a small capacity capacitor of such an extent that does not cause a problem with respect to the charging function of the control section 9*a* can be used.

Incidentally, a configuration is made such that a contact signal 13 based on an operation state of the control section 5*a* is outputted to be supplied to an interlock circuit 7*b* and the supply of the closing command 12*a* to the control section 4*a* is blocked while the contact signal 13 is inputted—this point is the same as Embodiment 1.

As described above, when the control units 10*a*, 10*b* having the same specification are used and the opening operation circuit is made duplex, a reduction in capacity of the capacitor of the closing operation circuit that does not need to be made duplex and a substitutional component such as the resistor corresponding to the coil can be applied, and specifications (function, performance, number of pieces, etc.) can be lowered than a component necessary for essentially doubling the control unit; and therefore, a cost reduction can be achieved.

Furthermore, the number of manufacturing lots is increased by manufacturing the control units 10*a*, 10*b* by the same manufacturing device and cost per one unit can also be suppressed.

Further, when the control unit 10*a* and the control unit 10*b* are constituted by an electronic substrate, each other's energization states between a control section 3*a* and the control section 4*a* or between the control section 5*a* and the control section 9*a* are detected and it becomes easily possible to control so as not to be energized at the same time. Therefore, the energization state of the control section 4*a* is, more specifically, the same as the energization state of the control section 9*a* and the control section 5*a* and the control section 9*a* can observe the energization states in the inside of one control unit 10*b*; and therefore, the contact signal 14 that is needed in Embodiment 1 can be omitted and a reduction in wiring can be achieved.

Embodiment 3

Figure 4:
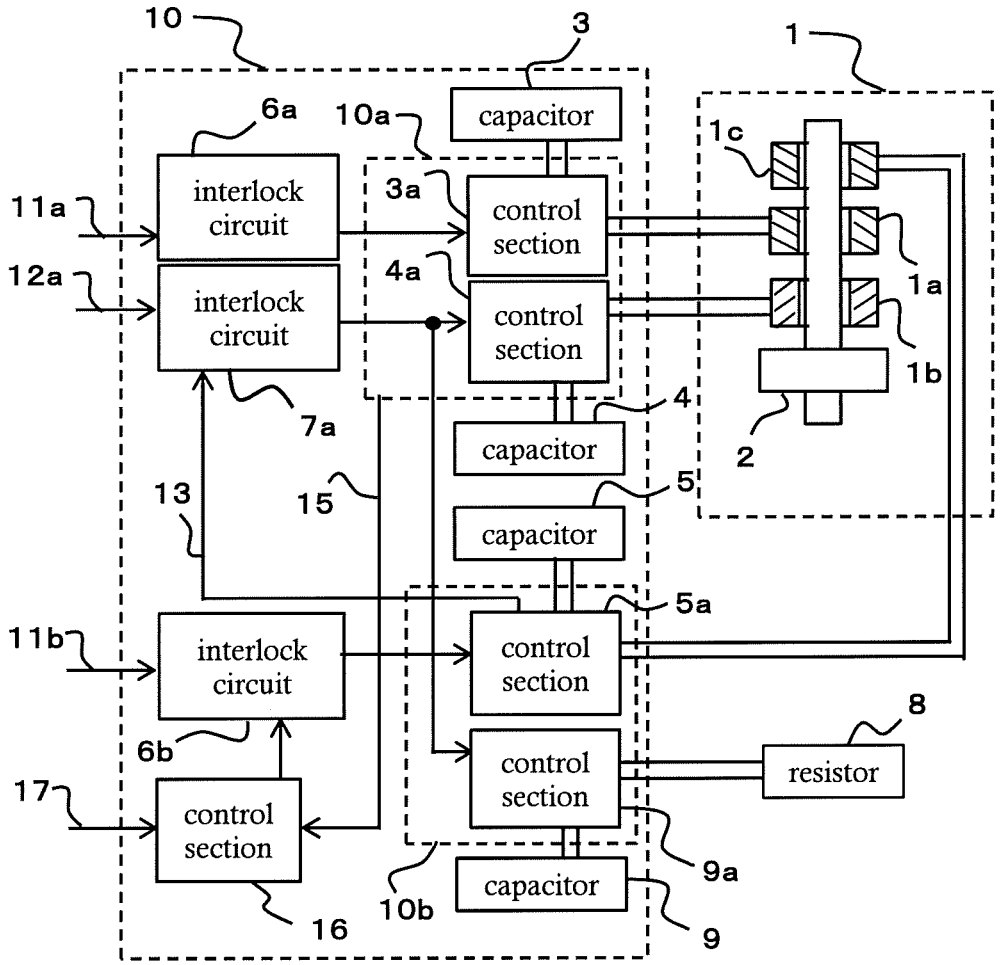
FIG. 4 is a general outline view showing an operation circuit of a circuit breaker in Embodiment 3 of the present invention.

FIG. 4 is a general outline view showing an operation circuit of a circuit breaker in Embodiment 3 of the present invention; and hereinafter, the present invention will be described on the basis of FIG. 4.

In FIG. 4, the same reference numerals as those shown in FIG. 1 and FIG. 3 represent identical or corresponding configuration and their description will be omitted.

Embodiment 3 shows the configuration of a case specialized for the purpose that an operation circuit to which a control unit 10*a* is connected is for normal operation and an operation circuit to which a control unit 10*b* is connected is for emergency opening contact.

More specifically, in the operation circuit for normal operation which includes control sections 3*a*, 4*a*; capacitors 3, 4; an opening coil 1*a*; and a closing coil 1*b*, when it becomes a state in which normal opening and closing operation cannot be performed due to a component defect or the like, a contact signal 15 of an alarm showing abnormality is outputted from the control unit 10*a* and the contact signal 15 is supplied to a control section 16. When the control section 16 receives the contact signal 15 of the alarm showing abnormality, the control section 16 outputs an open command to make a control section 5*a* operate and forcibly perform open via an interlock circuit 6*b*.

With such a circuit configuration, when abnormality is occurred in the operation circuit for normal operation, a system that immediately performs open operation from the control section 16 can be established without waiting for an opening command lib from the outside; and therefore, a false operation of the circuit breaker due to abnormality can be prevented and reliability in operating the circuit breaker can be improved.

Further, a contact signal 17 of an alarm from the outside of the circuit breaker is additionally inputted to the control section 16; and thus, when abnormality is occurred in switchgear including the circuit breaker and/or in any of a substation and the entire building in which the switchgear is introduced, it enables the circuit breaker to perform open operation and reliability in operating electric power reception facilities can be improved.

Incidentally, as an alarm contact other than the circuit breaker, for example, when gas insulation switchgear is applied, a gas leakage alarm contact is considered; and an alarm contact in the case of stopping a control power supply of the substation and/or the switchgear, an alarm contact showing a condition defect of peripheral devices to which the switchgear is connected, and the like are considered.

Further, in the aforementioned Embodiment 1 to Embodiment 3, the description has been made on the example of the circuit breaker; however, in addition to the switchgear that is a superordinate concept of the circuit breaker, more specifically, the circuit breaker having interruption capability of fault current of an electrical path, an electromagnetic contactor, a normal switch element, and the like can also be applied and similar effects can be obtained.

Incidentally, the present invention can appropriately change and/or omit the respective embodiments within the scope of the present invention.

DESCRIPTION OF REFERENCE NUMERALS

1: Electromagnetic operating device, 1*a*, 1*c*: Opening coil, 1*b*: Closing coil, 2: Movable element, 3, 5: Opening capacitor, 4: Closing capacitor, 3*a*, 4*a*, 5*a*, 9*a*: Control section, 6*a*, 6*b*, 7*a*: Interlock circuit, 8: Resistor, 9: Capacitor, 10: Operating circuit, 10*a*, 10*b*: Control unit, 11*a*, lib: Opening command, 12*a*: Closing command, 13, 14, 15: Contact signal, 16: Control section, 17: Contact signal, and 21: Capacitor.

The invention claimed is:

1. A switchgear comprising:

a closing coil that drives a movable element to the close contact side of said switchgear in an electromagnetic operating device;

a closing capacitor that supplies electrical energy to said closing coil;

a closing control section which is connected between said closing coil and said closing capacitor, and performs control of charging said closing capacitor and of energizing said closing coil;

an opening coil that drives said movable element to the open contact side of said switchgear in said electromagnetic operating device;

an opening capacitor that supplies electrical energy to said opening coil;

an opening control section which is connected between said opening coil and said opening capacitor, and performs control of charging said opening capacitor and of energizing said opening coil;

a first interlock circuit that energizes said opening control section;

a second opening coil that drives said movable element to the open contact side of said switchgear in said electromagnetic operating device;

a second opening capacitor that supplies electrical energy to said second opening coil;

a second opening control section which is connected between said second opening coil and said second opening capacitor, and performs control of charging said second opening capacitor and of energizing said second opening coil; and a second interlock circuit that energizes said second opening control section, wherein either said opening coil or said second opening coil is enabled to drive said movable element to the open contact side of said switchgear, and wherein reception, by said closing control section, of a command to activate the closing coil is blocked on the basis of a signal showing that said second opening control section is energizing said second opening coil.

2. The switchgear according to claim 1, wherein reception, by said second opening control section, of a command to activate the second opening coil is blocked on the basis of a signal showing that said closing control section is energizing said closing coil.

3. The switchgear according to claim 1, wherein said opening coil and said second opening coil are wound so as to be overlapped at the same position with respect to said movable element.

4. The switchgear according to claim 1, wherein said opening coil and said second opening coil are arranged side by side with respect to said movable element.

5. The switchgear according to claim 1, wherein said opening control section and said closing control section are constituted as one control unit.

6. The switchgear according to claim 5, further comprising:

a second control unit comprising said second opening control section and a second closing control section; and a resistor, in place of a coil, is connected to the second closing control section in said second control unit.

7. The switchgear according to claim 5, wherein said second interlock circuit is supplied with a contact signal due to abnormality of said control unit.

* * * * *